US012274336B2

(12) United States Patent
Garcin et al.

(10) Patent No.: US 12,274,336 B2
(45) Date of Patent: Apr. 15, 2025

(54) DEVICE FOR ADJUSTING THE LENGTH OF A BRACELET

(71) Applicant: MONTRES TUDOR SA, Geneva (CH)

(72) Inventors: Gilles Garcin, Les Acacias (CH); Thibaut Riotte, Pringy (FR)

(73) Assignee: MONTRES TUDOR SA, Geneva (CH)

( * ) Notice: Subject to any disclaimer, the term of this patent is extended or adjusted under 35 U.S.C. 154(b) by 0 days.

(21) Appl. No.: 18/168,070

(22) Filed: Feb. 13, 2023

(65) Prior Publication Data

US 2023/0255327 A1 Aug. 17, 2023

(30) Foreign Application Priority Data

Feb. 14, 2022 (EP) ..... 22156512

(51) Int. Cl.
*A44C 5/24* (2006.01)
*A44C 5/00* (2006.01)

(52) U.S. Cl.
CPC ..... *A44C 5/246* (2013.01); *A44C 5/0053* (2013.01)

(58) Field of Classification Search
CPC .... A44C 5/24; A44C 5/16; A44C 5/22; A44C 5/246; A44C 5/243; A44C 5/2071; A44C 5/0053
See application file for complete search history.

(56) References Cited

U.S. PATENT DOCUMENTS 5,771,543 A 6/1998 Froidevaux et al.
8,001,658 B2 8/2011 Christian et al.
(Continued)

FOREIGN PATENT DOCUMENTS

EP 0819391 A1 1/1998
EP 1908366 A1 4/2008
(Continued)

OTHER PUBLICATIONS

International Search Report and Written Opinion dated Sep. 19, 2022 in priority application No. EP22156512.0; with English partial translation and partial machine translation (total 10 pages).

*Primary Examiner* — Jack W Lavinder
(74) *Attorney, Agent, or Firm* — Seckel IP, PLLC

(57) ABSTRACT

An adjustment device (100; 100'; 100") for adjusting the length of a bracelet, having at least one adjustment assembly (10; 10'; 10") movable relative to a clasp cover (7; 7'; 7"), the adjustment assembly and the cover being respectively provided with a first and a second fixing element (11, 71; 11', 71'; 11", 71") for their respective fixing according to several positions capable of inducing different bracelet lengths, and also being provided respectively with a first and a second indexing element (21, 72; 21', 72'; 21", 72") for their temporary respective positioning according to one of the several positions, the adjustment assembly (10; 10'; 10") also comprising a guiding device including a first guiding element (3, 4, 5; 3', 4', 5'; 3", 4") cooperating with a second guiding element (74; 74'; 74") of the cover (7; 7'; 7") to guide the displacement of the adjusting assembly (10; 10'; 10") relative to the cover (7; 7'; 7"), the first indexing element (21; 21'; 21") being independent of and/or distinct from the first guiding element (3, 4, 5; 3', 4', 5'; 3", 4") and/or the second indexing element (72; 72'; 72") being independent of and/or distinct from the second guiding element (74; 74'; 74").

22 Claims, 10 Drawing Sheets

(56) References Cited

U.S. PATENT DOCUMENTS

| | | | | |
|---|---|---|---|---|
| 11,388,961 | B2 * | 7/2022 | Celant ..... | A44C 5/246 |
| 2008/0083101 | A1 | 4/2008 | Christian et al. | |
| 2019/0254391 | A1 | 8/2019 | Celant et al. | |
| 2020/0405018 | A1 | 12/2020 | Granito | |
| 2021/0059363 | A1 | 3/2021 | Celant et al. | |

FOREIGN PATENT DOCUMENTS

| | | | |
|---|---|---|---|
| WO | 2019158471 | A1 | 8/2019 |
| WO | 2019166671 | A1 | 9/2019 |

* cited by examiner

A-A

B-B

DEVICE FOR ADJUSTING THE LENGTH OF A BRACELET

RELATED APPLICATION

This application claims priority of EP patent application No. EP22156512.0 filed Feb. 14, 2022, the content of which is hereby incorporated by reference herein in its entirety.

TECHNICAL FIELD OF THE INVENTION

The present invention relates to a device for adjusting the length of a bracelet, particularly suited to a bracelet for a wristwatch provided with a deployant clasp disposed between two ends of the bracelet. It also relates to a clasp and a bracelet as such, incorporating such a device for adjusting the length of a bracelet, and to a timepiece such as a wristwatch as such comprising such an adjustment device.

BACKGROUND ART

A deployant clasp of the state of the art, provided to attach the two lengths of a watch bracelet around the wrist of its wearer, comprises several articulated blades, which can occupy a first position of closure in which the blades are attached, and a second position of opening in which the blades are no longer attached and allow the insertion or the removal of the bracelet. Such a clasp is generally provided with a first adjustment of its positioning relative to the bracelet, called conventional adjustment. However, the final length obtained is often not optimal.

For that, existing clasps are provided with a solution allowing a second adjustment of the length of bracelet, which can also be called comfort adjustment, complementing the first, conventional adjustment. The document EP0819391 describes such a solution, which relies on an adjustment link which pivots and can occupy two stable positions inducing two different lengths of the bracelet. The short position is maintained by a notch of the end link of the bracelet which comes to be attached and blocked elastically against the adjustment link in its short position. The document EP1908366 describes another solution in which an adjustment link of the bracelet can be displaced opposite a clasp cover of said bracelet, the adjustment link being fixed to the cover by notching. These existing solutions require careful manipulation on the part of a user when adjusting the length of the bracelet. This manipulation should notably allow a suitable positioning of movable elements relative to a notching, in order to obtain the desired length of the bracelet.

The document WO2019158471 describes another solution for adjusting the length of a bracelet, which reuses the principles of the solution set out in the document EP1908366 while adding an indexing device, which renders the application of the bracelet length adjustment more user-friendly.

One general objective of the invention is to further enhance the appeal of the adjustment of the length of a bracelet.

More particularly, the invention proposes a solution for adjusting the length of a bracelet, the operation of which is reliable and the manipulation of which is intuitive and user-friendly.

SUMMARY OF THE INVENTION

To this end, the invention relies on a device for adjusting the length of a bracelet, comprising an indexing device distinct from a guiding device of an adjustment link. In particular, elastic functional elements of, respectively, the indexing device and the guiding device are distinct.

In addition, the indexing device is also functionally distinct from a fixing device, and structurally wholly or partly distinct.

According to one embodiment, the device for adjusting the length of a bracelet comprises at least one adjustment assembly that is movable relative to a clasp cover, the adjustment assembly and the cover being respectively provided with a first and a second fixing element for their respective fixing according to several positions capable of inducing different bracelet lengths, the adjustment assembly and the cover being further provided respectively with a first and a second indexing element for their temporary respective positioning according to one of said several positions, the adjustment assembly comprising also a guiding device comprising a first guiding element cooperating with a second guiding element of the cover to guide the displacement of the adjustment assembly relative to the cover, wherein the first indexing element is independent of and/or distinct from the first guiding element and/or wherein the second indexing element is independent of and/or distinct from the second guiding element.

The invention is more particularly defined by the claims.

BRIEF DESCRIPTION OF THE DRAWINGS

These objects, features and advantages of the invention will be explained in detail in the following description of particular embodiments given in a nonlimiting manner in relation to the attached figures in which.

DETAILED DESCRIPTION OF PARTICULAR EMBODIMENTS

A device for adjusting the length of a bracelet in a clasp according to embodiments of the invention will now be described. This clasp and the bracelet are designed to fit the outline of a wrist of a wearer. In a reference frame defined relative to a wrist, the adjectives "inner" and "outer" will be used to respectively designate surfaces or elements oriented toward the wrist or away from the wrist. The longitudinal direction will designate the lengthwise direction of a bracelet length or of a clasp. The transverse direction will be the direction at right angle to the longitudinal direction, in the plane of the bracelet length or of the clasp.

FIGS. 1 to 11 illustrate a first embodiment of an adjustment device 100 for adjusting the length of a bracelet. This adjustment device 100 is contained within a deployant clasp 200 provided with a cover 7, within which an adjustment assembly 10 can slide. This adjustment assembly 10 and the cover 7 of the deployant clasp 200 together form the adjustment device 100 for adjusting the length of a bracelet.

Figure 1:
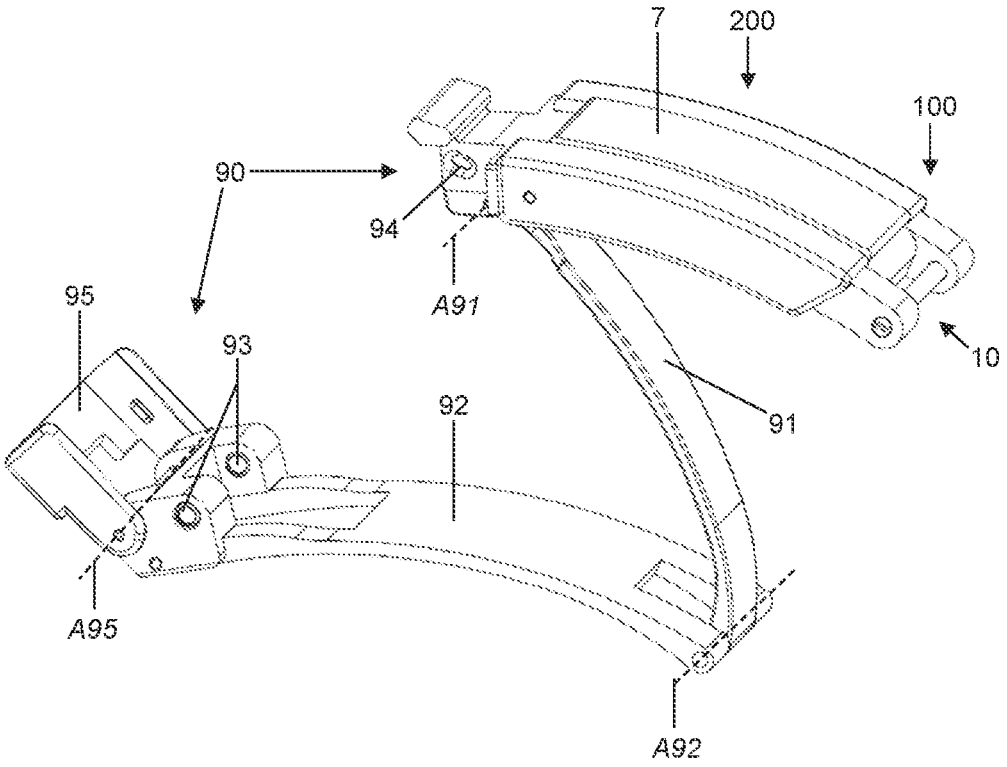
FIG. 1 represents a perspective view of a clasp in the position of opening incorporating a device for adjusting the length of a bracelet according to a first embodiment of the invention.
Figure 2:
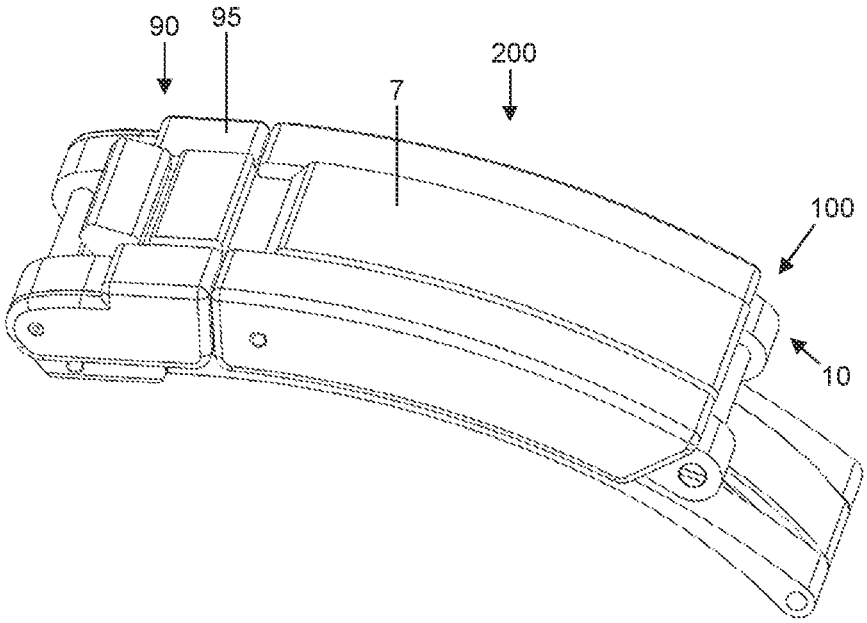
FIG. 2 represents a perspective view of the clasp in the position of closure incorporating the device for adjusting the length of a bracelet according to the first embodiment of the invention.
Figure 3:
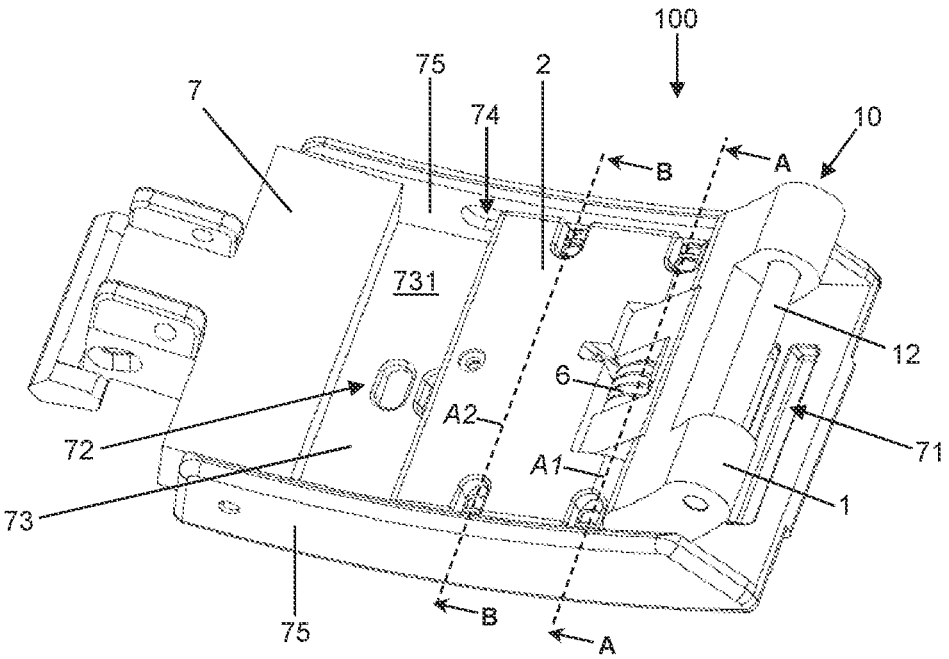
FIG. 3 represents a perspective view of the device for adjusting the length of a bracelet according to the first embodiment of the invention.

The deployant clasp 200 comprises two deployant blades 91, 92, as is notably visible in FIG. 1. A first longitudinal end of the first blade 91 is articulated on the cover 7 on a first axis A91, while a second longitudinal end of this first blade 91 is articulated at a first longitudinal end of the second blade 92 about a second axis A92. In particular, these blades 91, 92 are curved so as to best fit the form of the wrist of a wearer. In the closed position of the clasp, represented in FIG. 2, the two blades 91, 92 are folded one on top of the over and held in this configuration by a locking device 90 supported respectively by the cover 7 and by the second blade 92 at its second longitudinal end. The locking device 90 comprises notable ball pawls 93 housed in the second blade 92, which are provided to cooperate with notches 94 formed on the cover 7. The locking device 90 further comprises a safety cover 95 pivoted about an axis A95, which is provided to be folded back against the cover 7, once the blades 91 and 92 are folded down onto one another and held in this position by the balls of the ball pawls 93, which are held within notches 94. In this closed configuration of the clasp, the cover 7 is itself folded down to the two blades 91, 92, and extends substantially superposed on the first blade 91, such that the wearer can see the visible outer face of the cover 7, the two blades 91, 92 being concealed under the cover 7.

Figure 4:
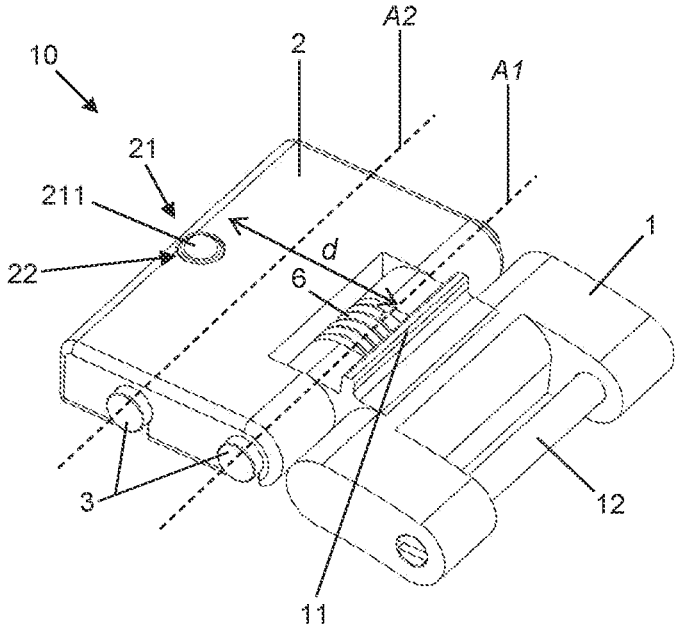
FIG. 4 represents a perspective view of an adjustment assembly of the device for adjusting the length of a bracelet according to the first embodiment of the invention.

The adjustment device 100 therefore comprises an adjustment assembly 10, more particularly represented in FIG. 4, which comprises a first link 1 and a second link 2, linked to one another in a way that is articulated about a first axis A1. The first link 1 comprises a tooth, which extends outward in a protruding manner, serving as first fixing element 11, which is provided to cooperate with a first succession of notches disposed on the outer wall 73 of the cover, more specifically in the inner surface 731 of the outer wall 73 of the cover, and serving as second fixing element 71. This second fixing element 71 therefore consists of a succession of notches arranged aligned longitudinally and so as to be centered in the inner surface 731 of the outer wall 73 of the cover 7, as is more particularly represented in FIG. 11. In this embodiment, the notches are advantageously not open, such that the visible outer surface of the outer wall 73 of the cover 7 remains continuous and has an attractive esthetic appearance. The first and second fixing elements together form a fixing device of the device for adjusting the length of the bracelet.

Moreover, the first link 1 of the adjustment assembly 10 also comprises a link axis 12 at its longitudinal end opposite the second link 2, which makes it possible to link said first link 1 to other links or linkages of a bracelet strand, notably of a metal bracelet, or to a length of a flexible bracelet. This way, the displacement of the adjustment assembly 10 causes the displacement of the bracelet strand and defines the length of the bracelet strand according to the position of the adjustment assembly 10.

The second link 2 of the adjustment assembly 10 comprises, for its part, a ball pawl, which extends in a protruding manner from its outer surface, serving as first indexing element 21. The ball 211 of the ball pawl is provided to cooperate with a second succession of notches disposed on the outer wall 73 of the cover 7, serving as second indexing element 72. The ball pawl is, here, inserted with lesser play in a bore 22 formed on the outer surface of the second link 2. Alternatively, this ball pawl could be fixed to the second link 2, notably by driving, brazing or welding. According to this embodiment, the second indexing element 72 consists of a succession of notches arranged aligned longitudinally and in a way that is centered in the inner surface 731 of the outer wall 73 of the cover 7, as is more particularly represented in FIG. 11. In particular, these notches of the second indexing element 72 are aligned with the notches of the second fixing element 71 in the longitudinal direction. As for the notches of the second fixing element 71, these notches of the second indexing element 72 are advantageously not open, such that the visible outer surface of the outer wall 73 of the cover 7 remains continuous and has an attractive esthetic appearance. The first and second indexing elements together form an indexing device of the device for adjusting the length of the bracelet.

The adjustment assembly 10 is mounted to be movable relative to the cover 7. Its displacement is guided in the cover 7 by a guiding device, which notably comprises guiding runners 3 arranged laterally on the second link 2, provided to slide in guideways or slideways 74 disposed respectively on each of the lateral walls 75 of the cover 7, as is visible in FIGS. 3, 5 and 6. First and second runners 3 are disposed at each of the ends of a first bar 4, arranged along the first transverse axis A1 on the two links 1, 2. This transverse axis A1 also defines an axis of articulation of the first and second links 1, 2. A return spring 6 is arranged around this axis, to return the first link 1 toward the cover 7, as will be detailed hereinbelow. Third and fourth runners 3 are also disposed at each of the ends of a second bar 5, arranged along a second transverse axis A2 of the second link 2, parallel to the first transverse axis A1. These two bars 4, 5 pass right through the second link 2, such that the runners 3 arranged on their two respective ends protrude from the two lateral walls of the second link 2, in order to be able to be housed in the abovementioned slideways 74 of the cover 7.

Figure 5:
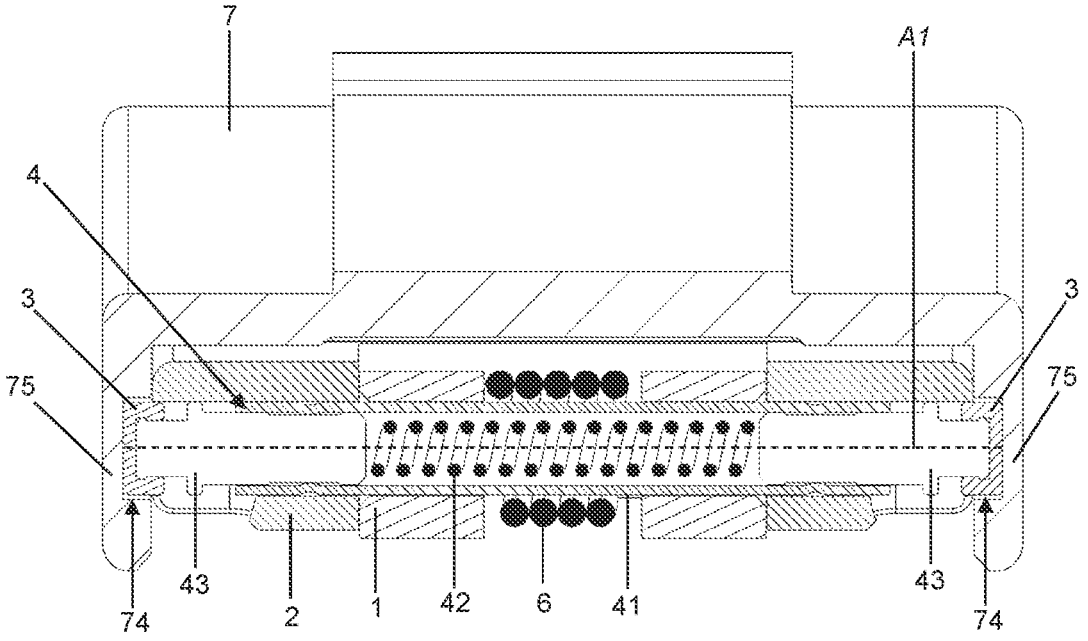
FIG. 5 represents a cross-sectional view in a transverse plane of the adjustment device at a first bar of the adjustment assembly according to the first embodiment of the invention.

The first bar 4, more particularly visible in FIG. 5, comprises an annular central part 41 in which is arranged a spring 42, which exerts an elastic thrust force on pivots 43 positioned at each of the ends of the bar 4. The runners 3 are disposed at the ends of each of the pivots 43. Thus, the spring 42 exerts an elastic thrust force on the runners 3, via the pivots 43, against the slideways 74 of the cover. This thrust force is designed to guarantee the ideal positioning of the runners 3 in the slideways to achieve a reliable displacement and a lesser play of the adjustment assembly 10.

Figure 6:
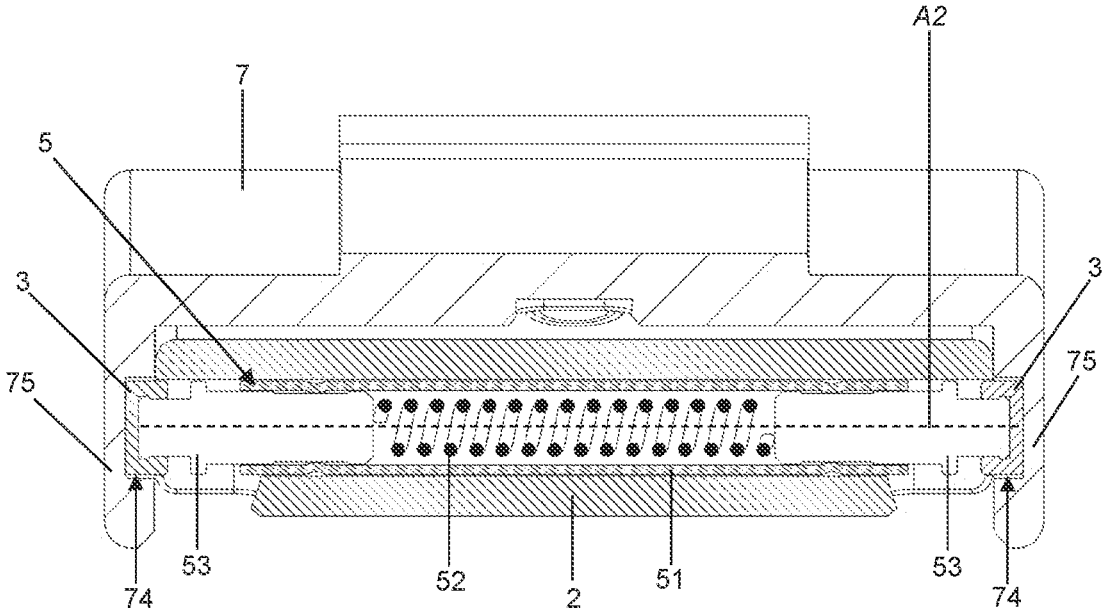
FIG. 6 represents a cross-sectional view in a transverse plane of the adjustment device at a second bar of the adjustment assembly according to the first embodiment of the invention.

Similarly, the bar 5, visible in FIG. 6, comprises an annular central part 51 in which is arranged a spring 52, which exerts an elastic thrust force on pivots 53 positioned at each of the ends of the bar 5. The runners 3 are disposed at the ends of each of the pivots 53. Thus, the spring 52 exerts an elastic thrust force on the runners 3, via the pivots 53, against the slideways 74 of the cover.

Finally, the bars 4, 5 and their runners 3 of the adjustment assembly 10, and the slideways 74 of the cover 7, together form a device for guiding the adjustment assembly 10, and therefore a guiding device of the adjustment device. The bars 4, 5 and their runners 3 represent a first guiding element of the guiding device, and the slideways 74 a second guiding element of the guiding device. Optionally, the runners 3 can represent a first longitudinal abutment element of the adjustment assembly 10 with respect to the cover 7, and the slideways 74 a second longitudinal abutment element of the adjustment assembly 10 with respect to the cover 7.

In this specific adjustment assembly construction 10, the link 1 is also returned elastically against the outer wall 73 of the cover 7, in particular against the inner surface 731 of the outer wall 73 of the cover 7, as mentioned previously, under the effect of a return spring 6 which here takes the form of a torsion spring. Through this, the first fixing element 11, that is to say the tooth of the first link 1 according to this embodiment, is returned elastically against a second fixing element 71, a notch of the cover according to this embodiment. Alternatively, the first fixing element could be fixed or blocked in a stable position opposite a notch under the effect of a notching device that can possibly involve, for example, one or more ball pawls, without necessarily the latter inducing an elastic return force pressing the first fixing element 11 against or toward the second fixing element 71.

FIGS. 7 to 10 are cross-sectional views through a vertical longitudinal medium plane, which illustrate the operation of the adjustment device 100, notably to allow a maximum extension of a bracelet provided with such an adjustment device.

Figure 7:
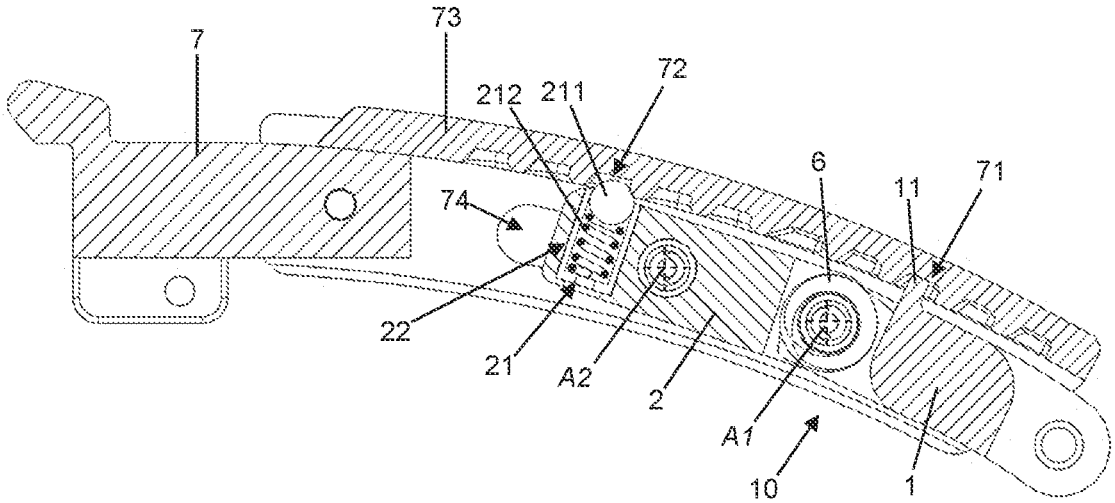
FIG. 7 represents a cross-sectional view in a longitudinal plane of the device for adjusting the length of a bracelet according to the first embodiment of the invention, in a first fixing position.

FIG. 7 illustrates the adjustment assembly 10 in a first fixing position with respect to the cover 7. This first position is a stable position, of fixing of the bracelet in the clasp. In this configuration, the tooth forming the first fixing element 11 is pressed into a notch belonging to the second fixing element 71 under the effect of the return spring 6. In addition, the ball 211 belonging to the first indexing element 21 is located or is roughly located in a notch belonging to the second indexing element 72, under the effect of an elastic element belonging to the first indexing element 21, in particular a spring 212 of the ball pawl. The fixing of the adjustment assembly 10 in the cover 7 is, here, mainly ensured by the fixing device 7, therefore by the cooperation of the two fixing elements, that is to say the tooth in a notch. Indeed, this fixing device is designed to guarantee the stable fixing of the adjustment assembly 10 on the cover 7, when the bracelet is worn conventionally.

Figure 8:
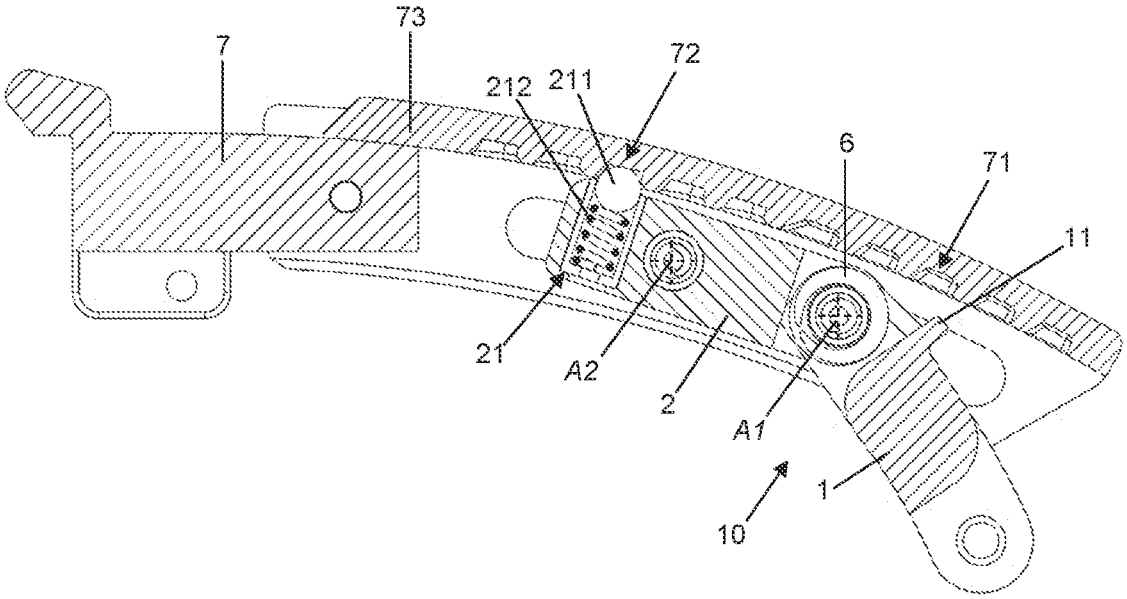
FIG. 8 represents a cross-sectional view in a longitudinal plane of the device for adjusting the length of a bracelet according to the first embodiment of the invention, in a first intermediate adjustment position.

FIG. 8 illustrates an actuation of the adjustment assembly 10 in a first, temporary intermediate position, in which the first link 1 is pivoted in a first direction of rotation about a first axis A1, against the return spring 6, so as to separate the tooth from the notch of the cover, thus releasing the first fixing element from the second fixing element 71. The tooth thus retracted from the notch allows the adjustment assembly 10 to slide in the cover 7, notably through the runners 3 provided to slide in guideways 74 formed on the lateral walls 75 of the cover. Note that, in the temporary configuration represented by FIG. 8, the ball 211, for its part, remains pressed against a notch of the cover under the effect of the spring 212. In other words, the first and second indexing elements remain engaged. However, as will be detailed hereinbelow, this indexing device is designed to allow the adjustment assembly to be temporary held relative to the cover but also to allow the sliding adjustment of the adjustment assembly.

Figure 9:
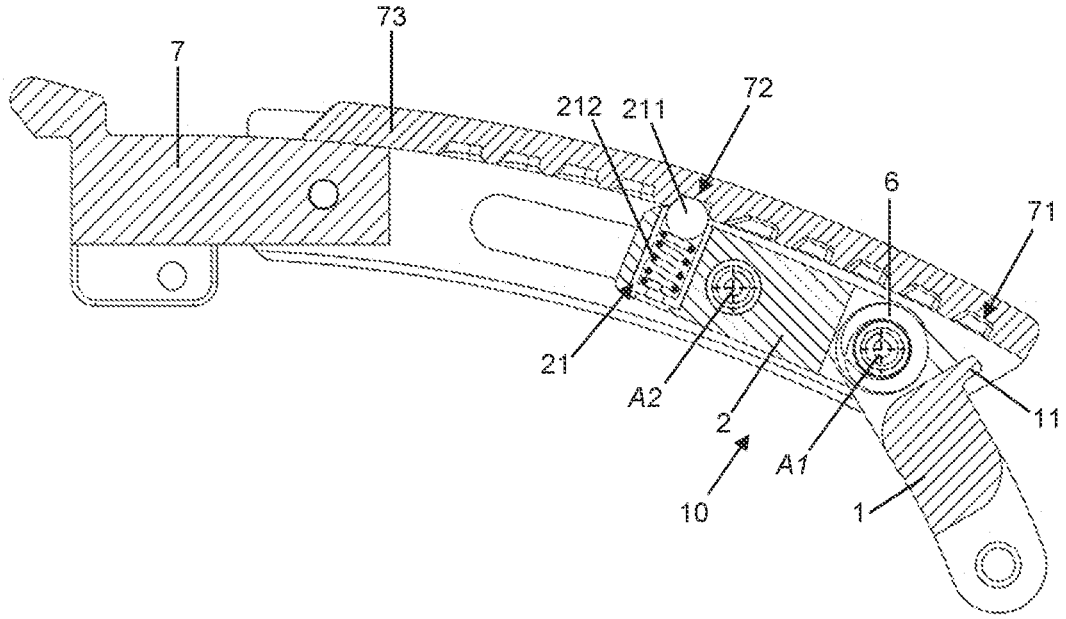
FIG. 9 represents a cross-sectional view in a longitudinal plane of the device for adjusting the length of a bracelet according to the first embodiment of the invention, in a second intermediate adjustment position.

Thus, the implementation of the adjustment is continued by the displacement of the adjustment assembly 10, for example, the position illustrated by FIG. 9, which corresponds to the maximum extension of the bracelet. Note that the adjustment assembly 10 can therefore be displaced with respect to the cover 7 according to several temporary stable positions defined by the two indexing elements 21, 72, namely the ball pawl and the succession of notches. The indexing device thus forms a pre-positioning means, which assists the user in adjusting the length of the bracelet, by allowing a suitable temporary positioning of the adjustment assembly, before acting appropriately on the fixing device. This indexing device is however not enough to fix the adjustment assembly, which can easily escape from the different index positions, by simple manual actuation of the user, to allow continued adjustment of the length of the bracelet. The indexing elements do not therefore fulfil a fixing function. They complement the fixing device which is distinct, as described previously.

FIG. 9 therefore illustrates the adjustment assembly 10 positioned in a temporary extreme position, with respect to the cover 7 (situated to the right, in FIGS. 7 to 10). In this position, the ball 211 is located in the last notch of the second indexing element 72.

Figure 10:
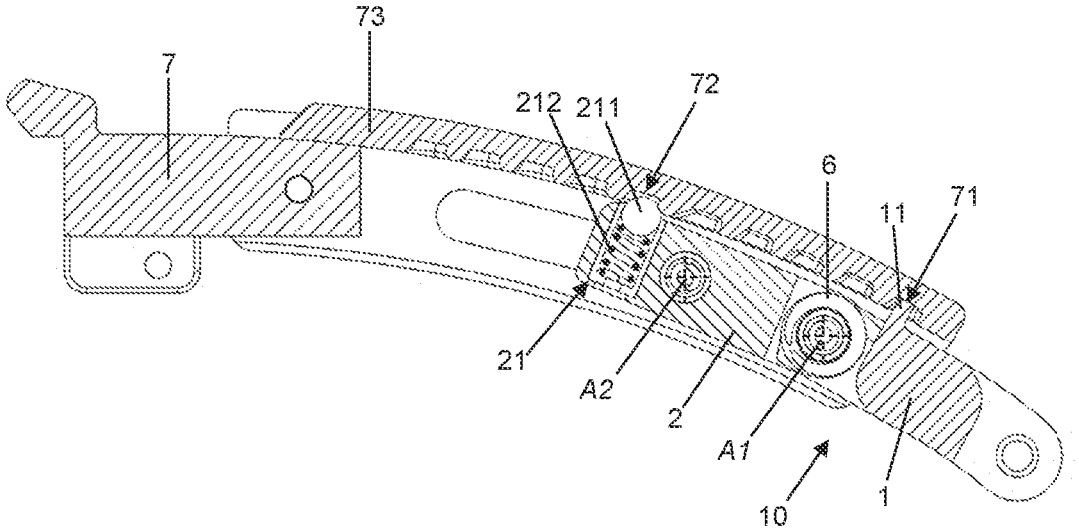
FIG. 10 represents a cross-sectional view in a longitudinal plane of the device for adjusting the length of a bracelet according to the first embodiment of the invention, in a second fixing position.
Figure 11:
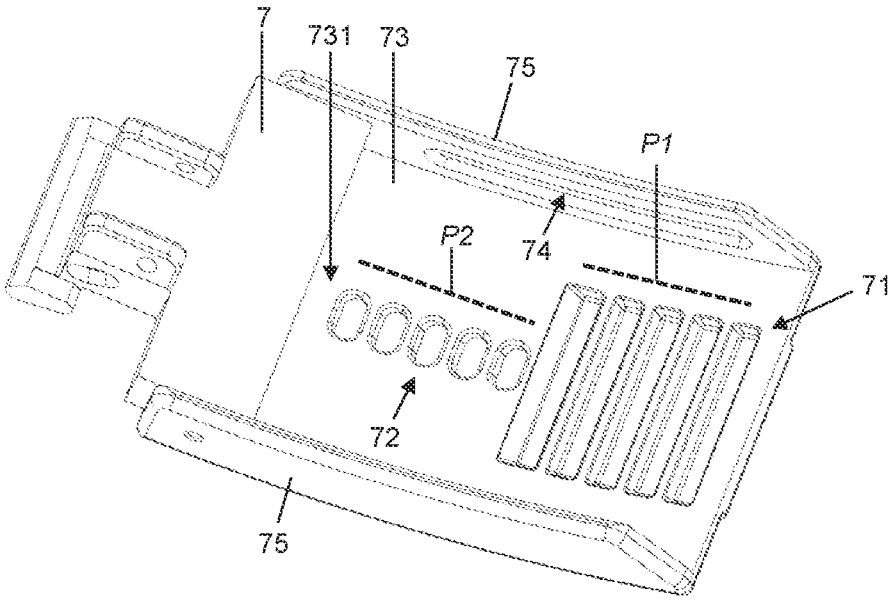
FIG. 11 represents a perspective view of a cover of the device for adjusting the length of a bracelet according to the first embodiment of the invention.

FIG. 10 illustrates the adjustment assembly 10 once the tooth 11 is positioned in the extreme notch of the second fixing element 71, following a rotation of the link 1 about the first axis A1 in a second direction of rotation opposite the above-mentioned first direction. The adjustment device is thus in a second fixing position, in which the length of the bracelet has been increased. In this specific second fixing position, the runners 3 disposed at the ends of each of the pivots 43 of the bar 4 are notable in abutment against a longitudinal end of each of the slideways 74. Naturally, any other adjustment of length is possible according to the same operation, the displacement in the reverse direction (to the left, in FIGS. 7 to 10) of the adjustment assembly allowing a shortening of the bracelet.

In this first embodiment of the adjustment device, the succession of notches forming the second fixing element 71 is arranged according to a first longitudinal portion P1 of the outer wall 73 of the cover 7, while the succession of notches forming the second indexing element 72 is arranged according to a second longitudinal portion P2 of the outer wall 73 of the cover 7. The abovementioned first and second portions are distinct and arranged in continuity of one another in the longitudinal direction, as is more particularly visible in FIG. 11. In other words, the second fixing element and the second indexing element are distinct. Similarly, the first fixing element and the first indexing element are distinct.

Preferentially, there are as many notches of the fixing device as there are notches of the indexing device, for example five according to the embodiment illustrated. Naturally, any other number of notches is possible, notably two, three or four, even more than five. Moreover, the distance or the pitch separating two successive notches of, respectively, the fixing device and the indexing device is advantageously the same or substantially the same. Thus, the architecture of the adjustment device is such that when the indexing elements are engaged, the fixing elements can cooperate to achieve a fixing position of the adjustment device.

Figure 12:
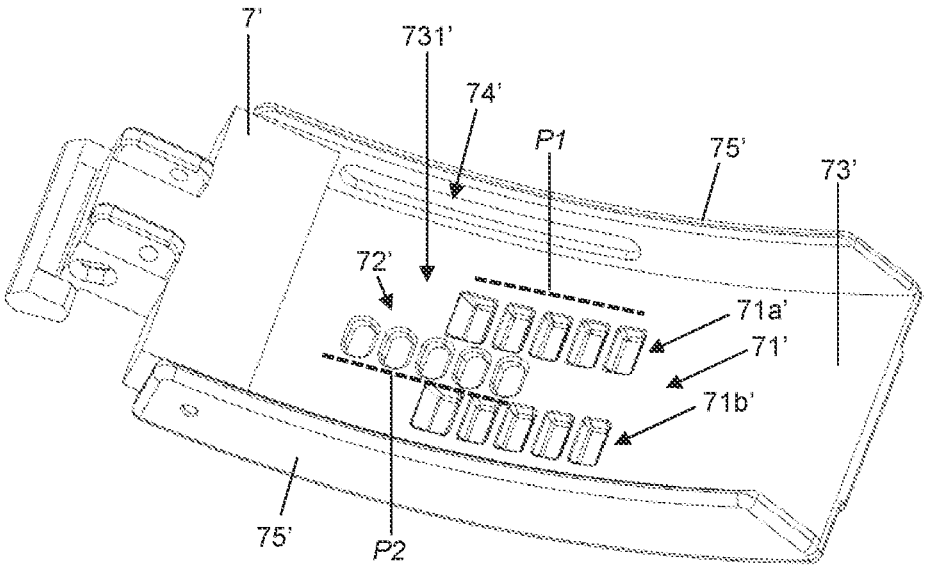
FIG. 12 represents a perspective view of a cover of a device for adjusting the length of a bracelet according to a second embodiment of the invention.

FIGS. 12 to 15 illustrate a second embodiment of an adjustment device 100' for adjusting the length of a bracelet. As represented by FIG. 12, this second embodiment differs from the first embodiment in that the notches forming, respectively, the second fixing elements 71*a*', 71*b*' and the second indexing element 72' are arranged differently, but in the inner surface 731' of the outer wall 73' of the cover 7'.

Indeed, the first and second portions P1 and P2 respectively comprising the notches of the second fixing element 71' and those of the second indexing element 72' partially overlap. The second fixing element in fact comprises two parallel longitudinal successions of notches 71*a*', 71*b*', arranged laterally on the outer wall 73' of the cover 7'. The notches of the second indexing element 72' form a longitudinal succession of notches arranged in the central part of the outer wall 73' of the cover. In addition, these notches of the second indexing element 72' are at least partially interleaved between the notches 71*a*', 71*b*' of the second fixing element 71'. In other words, there is a zone of the outer wall 73' of the cover 7' where the portions P1, P2 overlap, and where notches of the second indexing element 72' can be disposed between two notches of the second fixing element 71' in the transverse direction.

Such an arrangement makes it possible to maximize the number of notches respectively of the second indexing element 72' and of the second fixing element 71' since they are likely to be able to extend over the entire outer wall of the cover 7' in the longitudinal direction. More generally, such an arrangement therefore makes it possible to maximize the range of adjustment of the length of a bracelet for a given longitudinal cover extent.

Figure 13:
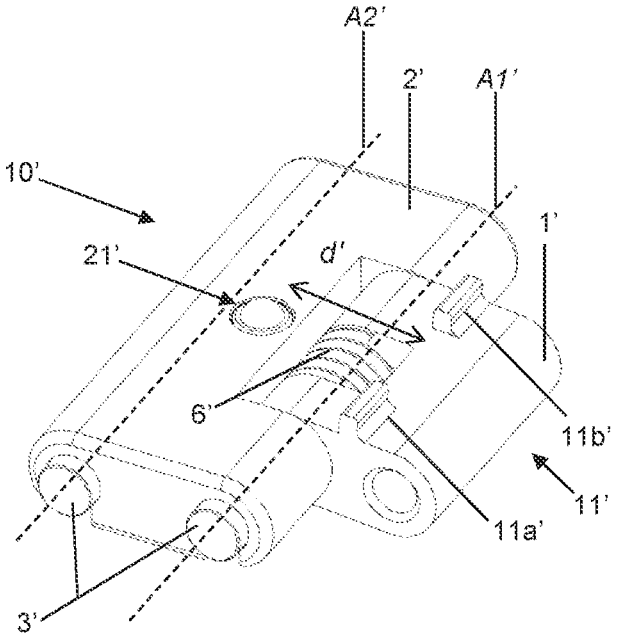
FIG. 13 represents a perspective view of an adjustment assembly of the device for adjusting the length of a bracelet according to the second embodiment of the invention.

FIG. 13 illustrates an adjustment assembly 10' suited to such a cover 7' described above. This adjustment assembly 10' is distinguished from that of the first embodiment in that its first link 1' comprises two teeth 11*a*', 11*b*' forming the first fixing element 11', aligned transversely, designed to each cooperate with one of the longitudinal successions of notches 71*a*', 71*b*' forming the second fixing element 71'.

Also, the first indexing element 21' of the second link 2' is, here, brought closer to the teeth 11*a*', 11*b*' of the first fixing element 11'. In other words, the distance d' separating them in the longitudinal direction is reduced relative to the distance d of the first embodiment, represented in FIG. 4. This second embodiment thus makes it possible to provide an adjustment assembly 10' that is more compact than the adjustment assembly 10 of the first embodiment.

Figure 14:
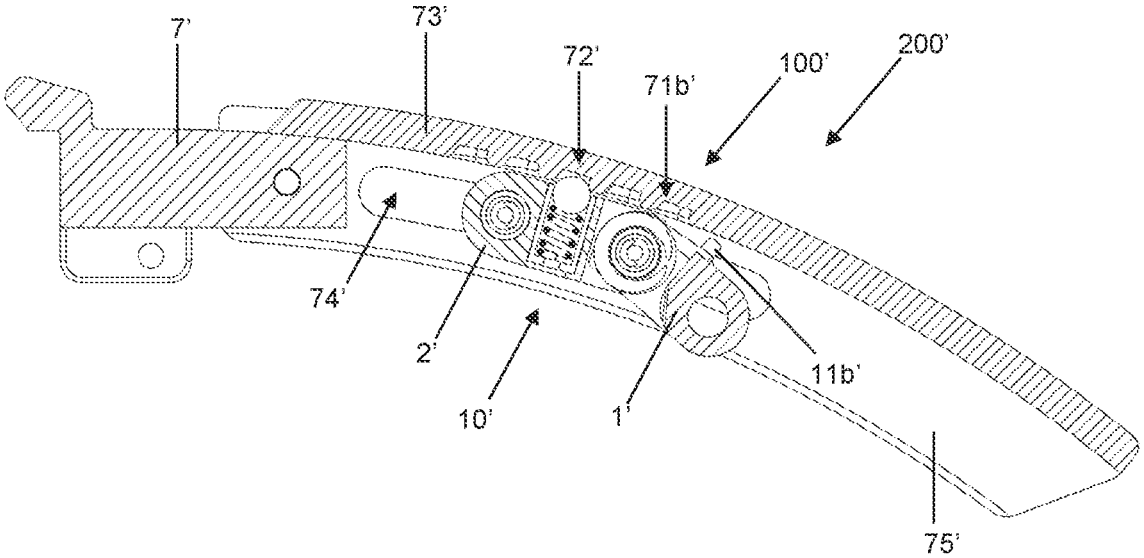
FIG. 14 represents a cross-sectional view in a longitudinal plane of the device for adjusting a length of a bracelet according to the second embodiment of the invention, in an intermediate adjustment position.
Figure 15:
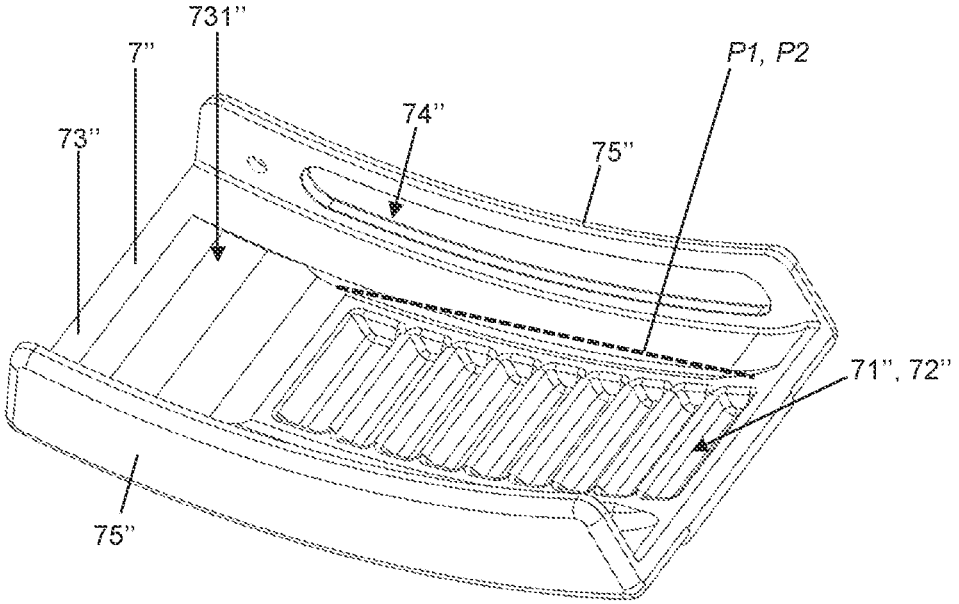
FIG. 15 represents a perspective view of a cover of a device for adjusting the length of a bracelet according to a third embodiment of the invention.

Other features of this second embodiment remain substantially unchanged, and the principle of operation of the adjustment device 100' of the second embodiment is also similar or identical to that of the adjustment device 100 of the first embodiment. As an illustration, FIG. 14 illustrates the adjustment device 100' in a length adjustment phase, in which the teeth 11*a*' (not visible), 11*b*' of the adjustment assembly 10' are retracted from a given pair of notches 71*a*' (not visible) and 71*b*' of the second fixing element.

As for the first embodiment, there are preferentially as many pairs of notches 71*a*', 71*b*' of the second fixing element 71*a*' as there are notches of the second indexing element 72'. Moreover, the distance separating two notches or two pairs of notches of the second fixing element is advantageously the same or substantially the same as that separating two notches of the second indexing element 72'.

FIGS. 15 to 18 illustrate a third embodiment of an adjustment device 100' for adjusting the length of a bracelet. This embodiment is differentiated from the first two in that the second fixing element 71" and the second indexing element 72" are combined. In other words, as appears in FIG. 15, a single longitudinal succession of notches in the inner surface 731" of the outer wall 73" of the cover 7" forms both the second fixing element 71" and the second indexing element 72". One and the same notch can thus simultaneously receive a first fixing element and a first indexing element. To put it another way, the first and second portions P1 and P2 overlap and are notably combined. Such an arrangement makes it possible to even further maximize the number of notches forming the second fixing element 71" and the second indexing element 72" for a given longitudinal cover extent.

Figure 16:
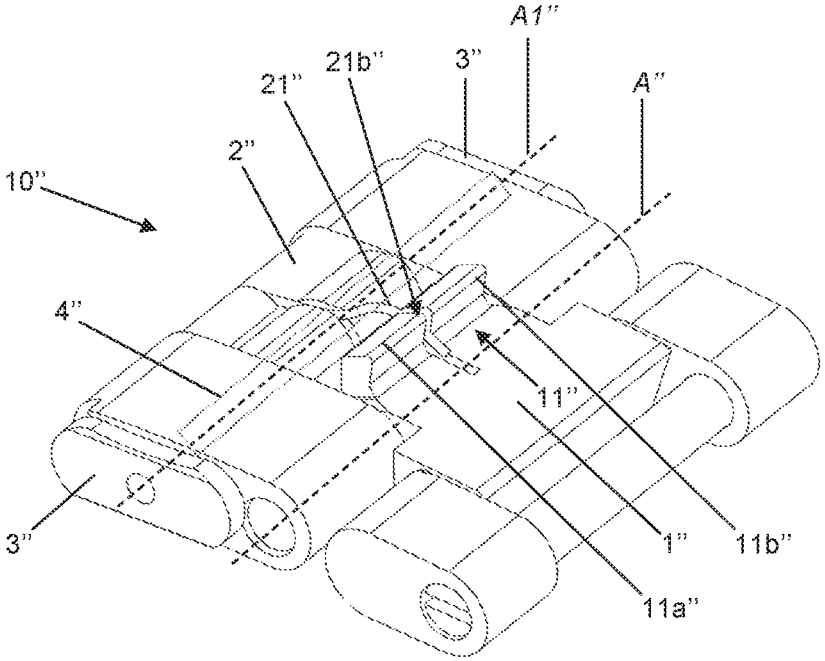
FIG. 16 represents a perspective view of an adjustment assembly of the device for adjusting the length of a bracelet according to the third embodiment of the invention.

As represented in FIG. 16, the adjustment assembly 10" comprises two articulated links 1", 2". The first link 1" comprises two teeth 11*a*" and 11*b*" aligned in the transverse direction, forming the first fixing element 11". The second link 2" comprises the first indexing element 21", which here takes the form of a wire spring 21", of which a bent-back first end 21*a*" at least partially clads or sleeves an axis 23", and a free second end 21*b*", disposed substantially between the two teeth 11*a*", 11*b*", is designed to cooperate with a notch forming the second indexing element 72" of the cover 7". The distance separating the end 21*b*" of the teeth 11*a*", 11*b*" in the longitudinal direction is nil or substantially nil in this embodiment, which makes it possible to further increase the compact nature of the adjustment assembly 10".

Note that, in this embodiment, the adjustment assembly 10" also has the specific feature of comprising a single pair of runners 3" arranged on either side of the second link 2" on a first axis A1", about which is articulated the first link 1", relative to the second link 2" (more particularly at a bar 4" disposed around the axis A1"). A system of ball pawls (not visible in the figures), disposed on another axis A", parallel to the first axis A1", for its part makes it possible to block the first link 1" relative to the second link 2", and therefore to block the two teeth 11*a*", 11*b*" opposite a notch of the second fixing element 71" of the outer wall 73" of the cover 7".

The operating principle of the adjustment device 100" is similar to that of the adjustment devices 100, 100' of the preceding two embodiments. One difference stems notably from the fact that the first link 1" is not returned elastically against the outer wall 73" of the cover 7", but is blocked in rotation relative to the second link 2" through the above-mentioned system of ball pawls, according to a position which makes it possible to guarantee the fixing of the adjustment element 100" on the cover 7". In all the embodiments, there is therefore an elastic element which makes it possible, directly or indirectly, to act on the first fixing element to displace it and/or keep it toward the cover or opposite the cover.

Figure 17:
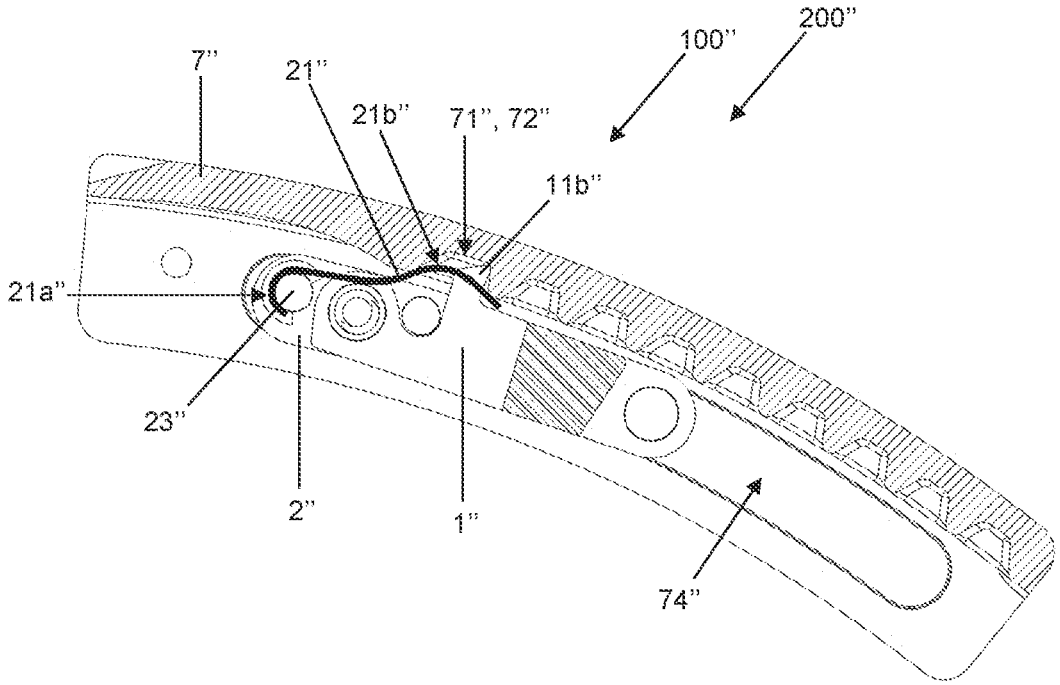
FIG. 17 represents a cross-sectional view in a longitudinal plane of the device for adjusting the length of a bracelet according to the third embodiment of the invention, in an intermediate adjustment position.

As an illustration, FIG. 17 represents the adjustment device 100" in which the adjustment assembly 10" is in a fixing position with respect to the cover 7", by the cooperation of the portions of teeth 11*a*" (not visible) and 11*b*" with a first notch of the second fixing element 71". In this configuration, the free end 21*b*" of the wire spring 21" also cooperates with the same first notch, which is also a notch forming a second indexing element 72". This configuration corresponds here to a fixing position according to a minimal extension of bracelet provided with such an adjustment device 100".

In this embodiment, the second indexing 71" and fixing 72" elements comprise nine notches, which define as many positions of the adjustment assembly 10" with respect to the cover 7", and more generally lengths of a bracelet.

Figure 18:
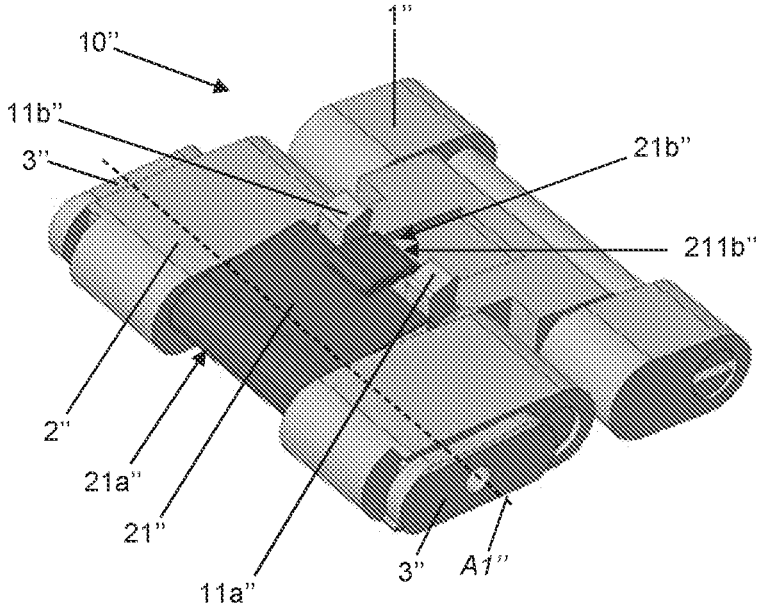
FIG. 18 represents a perspective view of an adjustment assembly of the device for adjusting the length of a bracelet according to a variant of the third embodiment of the invention.

As a variant, the spring 21" could have a different form. As an example, FIG. 18 illustrates a spring 21" in the form of a blade, the free end 21*b*" of which has a protuberance 211*b*" provided to improve the cooperation with the succession of notches.

In the embodiment illustrated in FIGS. 15 to 18, the notches arranged on the outer wall 73" of the cover 7" extend continuously over a significant length in the transverse direction. Each notch thus comprises different zones that can belong to the second indexing element or to the second fixing element. Notably, the central zone of each notch can cooperate with a first indexing element 21", and thus more specifically forms a second indexing element 72". In addition, the lateral zones of each notch form zones that can cooperate with a first fixing element 11", and thus belong to the second fixing element. Naturally, as a variant, each notch can be separated into distinct zones, to thus separate the second indexing and fixing elements, according to a conformation approximating the second embodiment.

The invention is not limited to the embodiments described. These embodiments can be combined with one another to form other embodiments.

In addition, in each of three embodiments, the notches formed on the inner surface 731; 731'; 731" of the outer wall 73; 73'; 73" of the cover 7; 7'; 7" are not through-notches, so as not to be visible from the outside and leave the visible outer surface of the cover intact. As a variant, these notches could naturally be through-notches, and could therefore be visible from the outside of the cover.

In addition, as has been described, the notches arranged in the outer wall of the cover can extend in the form of a row in the longitudinal direction, and can extend continually or not in the transverse direction, one and the same notch being able to comprise different zones to fulfil the two indexing and fixing functions, which thus seem to be combined on the cover. As a variant, the notches could be totally distinct for each of these two functions.

The notches forming the second fixing element can be centered or not on the outer wall of the cover. The profile of these notches can be symmetrical or asymmetrical, in order to generate a different sensation or release according to the direction of activation of the adjustment assembly.

Figure 19:
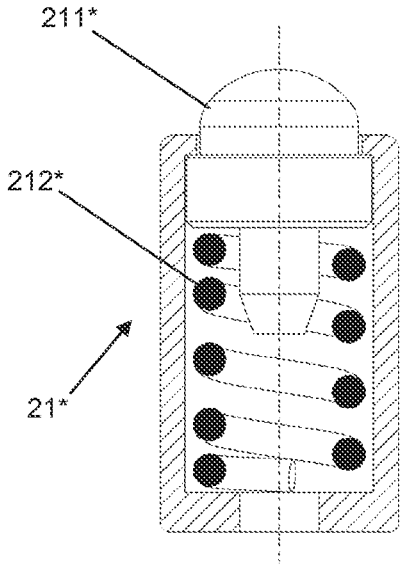
FIG. 19 represents a cross-sectional view of a variant indexing element for a device for adjusting the length of a bracelet.

The same applies with respect to the first indexing element. Thus, the first indexing element can take the form of a ball pawl. More generally, this ball can be replaced by any element provided with a hemispherical form, notably by a cylinder or a stud provided with an end having a hemispherical form. Alternatively, this ball can be replaced by a cylinder or a stud, one end of which is provided with a tooth, this tooth being able to have a symmetrical or asymmetrical profile. Thus, more generally, the first indexing element can take the form of an elastic ratchet. Such an elastic ratchet may or may not be non-removable. As an example, FIG. 19 illustrates a variant first indexing element taking the form of a non-removable elastic ratchet 21 comprising a stud 211**, one end of which has a hemispherical form, which is returned elastically by a spring 212**. As a variant, the first indexing element can take the form of a spring, such as a wire spring or a leaf spring, as represented by the third embodiment. In such a case, the free end 21***b*" of the spring 21" can have a symmetrical or asymmetrical profile. More generally, the first indexing element comprises one or more elastic elements, that can cooperate elastically with a notch of the cover.

Similarly, the first fixing element could take a form other than those illustrated. It can comprise any form of teeth, symmetrical or not, and any number of teeth.

As a variant, the indexing elements and/or the fixing elements can be reversed. For example, the first fixing element could be on the second link, which would be retractable, and the first indexing element could be located on the first link of the adjustment assembly. In yet another variant, the notches could be arranged on the adjustment assembly and not on the cover, the latter then comprising a protruding elastic element for the indexing function, and one or more teeth protruding toward the adjustment assembly for the fixing function.

Also, the adjustment assembly is preferably guided in the clasp cover by a guiding device, in particular through guiding runners provided to slide in guideways or slideways, disposed respectively on each of the lateral walls of the cover. Alternatively, the guiding device could take any other form. For example, the latter could comprise more simply a protuberance formed notably on an outer surface of the second link of the adjustment assembly, which is provided to slide in a groove formed on the outer wall of the cover. Preferably, the first guiding element comprises a protruding element, such as a runner, and an elastic element, for example disposed in a bar, to act on the element protruding toward the cover, in order to keep said element cooperating with the second guiding element of the cover, notably a groove or a slideway as represented in the different embodiments.

Such a design of the adjustment device advantageously makes it possible to offer an indexing device of the adjustment assembly that is totally or partially independent of or distinct from the guiding device of said adjustment assembly. Notably, the first indexing element can be distinct from and/or independent of the first guiding element. For example, the first indexing element can comprise an elastic element, as described previously, distinct from an elastic means used in the first guiding element. In other words, the elastic element of the first indexing element is distinct from the guiding device. The first indexing element can, as a variant or in addition, be distinct from and/or independent of the second guiding element arranged on the cover. More specifically, the ball or the elastic element or any protruding element belonging to the first indexing element can cooperate with a zone of the cover that is distinct from the second guiding element, for example outside of a groove or a slideway provided for the guiding of the adjustment assembly. In yet another variant, the second indexing element, arranged on the cover, can be distinct from and/or independent of the second guiding element. Notably, the second indexing element can be arranged on a wall of the cover distinct from the wall on which the second guiding element is arranged. The second indexing element can also be independent of and/or distinct from the first guiding element, that is to say that this first guiding element does not cooperate with the second indexing element for the implementation of the guiding function.

Likewise, the indexing device is at least partially independent of and/or distinct from the fixing device.

Preferentially, the adjustment device fits in a deployant clasp provided with a locking device. Obviously, the clasp could take any other form. In particular, the locking device could have no safety cover.

By virtue of the adjustment device of the invention, the adjustment of the length of a bracelet becomes an assisted and very user-friendly adjustment. If the user wants to continue the adjustment, he or she continues displacement of the adjustment assembly, and his or her force allows the disengagement of the intermediate indexing elements encountered, against the force of the elastic element of the indexing device, in particular of the first indexing element.

The invention also relates to a bracelet and/or a clasp and/or a wristwatch, which incorporates a device for adjusting the length of a bracelet as described previously.

The invention claimed is:

1. An adjustment device for adjusting a length of a bracelet, the adjustment device comprising at least one adjustment assembly that is movable relative to a clasp cover, the adjustment assembly being provided with a first fixing element and the clasp cover being provided with a second fixing element, the first fixing element and the second fixing element being adapted to cooperate with each other for fixing the adjustment assembly relative to the clasp cover according to several positions capable of inducing different bracelet lengths, the adjustment assembly being provided with a first indexing element and the clasp cover being also provided with a second indexing element, the first indexing element and the second indexing element being capable of cooperating with each other for temporary positioning of the adjustment assembly relative to the clasp cover according to one of the several positions, the adjustment assembly comprising a guiding device comprising a first guiding element, and the clasp cover comprising a second guiding element, the first guiding element and the second guiding element being capable of cooperating with each other to guide a displacement of the adjustment assembly relative to the clasp cover, wherein the first indexing element is independent of and/or distinct from the first guiding element, the second indexing element is independent of and/or distinct from the second guiding element, or both the first indexing element is independent of and/or distinct from the first guiding element and the second indexing element is independent of and/or distinct from the second guiding element, wherein the second guiding element of the clasp cover and the second indexing element of the clasp cover are arranged on distinct walls of the clasp cover, respectively on lateral walls and on an outer wall connecting the lateral walls.

2. The adjustment device as claimed in claim 1, wherein the first indexing element comprises an elastic element distinct from the guiding device.

3. The adjustment device as claimed in claim 1, wherein the first indexing element comprises an elastic element and the second indexing element comprises a longitudinal row of notches, arranged respectively on an outer surface of the adjustment assembly and on an outer wall of the clasp cover, or vice versa.

4. The adjustment device as claimed in claim 3, wherein the elastic element is selected from the group consisting of elastic pawls, wire springs, and leaf springs.

5. The adjustment device as claimed in claim 3, wherein the elastic element is a ball pawl.

6. The adjustment device as claimed in claim 3, wherein the first indexing element and the second indexing element are arranged respectively on the outer surface of the adjustment assembly and on an inner surface of the outer wall of the cover, or vice versa.

7. The adjustment device as claimed in claim 1, wherein the adjustment assembly comprises:

two links articulated with respect to one another, the first link comprising a first fixing element and the second link comprising the first indexing element, and an elastic element exerting a force making it possible to elastically return the first fixing element toward or against the second fixing element of the clasp cover or to block the first fixing element facing the second fixing element.

8. The adjustment device as claimed in claim 7, wherein the elastic element includes a spring or one or more ball pawls.

9. The adjustment device as claimed in claim 1, wherein the second indexing element and the second fixing element comprise at least one succession of distinct notches, arranged aligned in a longitudinal direction and/or so as to be at least partially interleaved in a traverse direction.

10. The adjustment device as claimed in claim 1, wherein the first guiding element comprises runners arranged on lateral surfaces of the adjustment assembly cooperating with the second guiding element.

11. The adjustment device as claimed in claim 10, wherein the first guiding element comprises runners arranged at two ends of at least one transverse bar, the at least one transverse bar comprising a spring arranged so as to exert an elastic thrust force on the runners toward the clasp cover.

12. The adjustment device as claimed in claim 11, wherein the spring is arranged so as to exert an elastic thrust force on the runners toward lateral walls of the clasp cover.

13. The adjustment device as claimed in claim 10, wherein the runners arranged on the lateral surfaces of the adjustment element cooperate with slideways arranged in lateral walls of the clasp cover.

14. The adjustment device as claimed in claim 1, wherein the first and second fixing elements include one or more teeth arranged on a link of the adjustment assembly and a row of notches arranged on an outer wall of the clasp cover, or vice versa.

15. The adjustment device as claimed in claim 14, wherein the first and second fixing elements include the one or more teeth arranged on the link of the adjustment assembly and the row of notches arranged on an inner surface of the outer wall of the clasp cover, or vice versa.

16. The adjustment device as claimed in claim 1, wherein notches of the indexing device are distributed according to a pitch that is equal or substantially equal to a pitch separating notches of the fixing device, and correspondingly, so that each position defined by the indexing device has a corresponding fixing position of the fixing device.

17. A deployant clasp for bracelets, wherein the deployant clasp comprises the adjustment device as claimed in claim 1.

18. A bracelet, wherein the bracelet comprises a deployant clasp as claimed in claim 17.

19. A timepiece, wherein the timepiece comprises a bracelet as claimed in claim 18.

20. The adjustment device as claimed in claim 1, wherein the second indexing element and the second fixing element comprise a same succession of notches.

21. An adjustment device for adjusting a length of a bracelet, the adjustment device comprising at least one adjustment assembly that is movable relative to a clasp cover, the adjustment assembly being provided with a first fixing element and the clasp cover being provided with a second fixing element, the first fixing element and the second fixing element being adapted to cooperate with each other for fixing the adjustment assembly relative to the clasp cover according to several positions capable of inducing different bracelet lengths, the adjustment assembly being provided with a first indexing element and the clasp cover being also provided with a second indexing element, the first indexing element and the second indexing element being capable of cooperating with each other for temporary positioning of the adjustment assembly relative to the clasp cover according to one of the several positions, the adjustment assembly comprising a guiding device comprising a first guiding element, and the clasp cover comprising a second guiding element, the first guiding element and the second guiding element being capable of cooperating with each other to guide a displacement of the adjustment assembly relative to the clasp cover, wherein the first indexing element is independent of and/or distinct from the first guiding element, the second indexing element is independent of and/or distinct from the second guiding element, or both the first indexing element is independent of and/or distinct from the first guiding element and the second indexing element is independent of and/or distinct from the second guiding element, wherein the second indexing element and the second fixing element comprise at least one succession of distinct notches, arranged aligned in a longitudinal direction and/or so as to be at least partially interleaved in a traverse direction.

22. An adjustment device for adjusting a length of a bracelet, the adjustment device comprising at least one adjustment assembly that is movable relative to a clasp cover, the adjustment assembly being provided with a first fixing element and the clasp cover being provided with a second fixing element, the first fixing element and the second fixing element being adapted to cooperate with each other for fixing the adjustment assembly relative to the clasp cover according to several positions capable of inducing different bracelet lengths, the adjustment assembly being provided with a first indexing element and the clasp cover being also provided with a second indexing element, the first indexing element and the second indexing element being capable of cooperating with each other for temporary positioning of the adjustment assembly relative to the clasp cover according to one of the several positions, the adjustment assembly comprising a guiding device comprising a first guiding element, and the clasp cover comprising a second guiding element, the first guiding element and the second guiding element being capable of cooperating with each other to guide a displacement of the adjustment assembly relative to the clasp cover, wherein the first indexing element is independent of and/or distinct from the first guiding element, the second indexing element is independent of and/or distinct from the second guiding element, or both the first indexing element is independent of and/or distinct from the first guiding element and the second indexing element is independent of and/or distinct from the second guiding element, wherein the second indexing element and the second fixing element comprise a same succession of notches.

* * * * *